United States Patent [19]

Hartmann

[11] Patent Number: 4,716,799

[45] Date of Patent: Jan. 5, 1988

[54] TICKET DISPENSING MACHINE AND METHOD

[75] Inventor: Donald Hartmann, Reno, Nev.

[73] Assignee: Syntech International, Inc., Reno, Nev.

[21] Appl. No.: 895,768

[22] Filed: Aug. 12, 1986

[51] Int. Cl.[4] ..... B26D 3/00

[52] U.S. Cl. ..... 83/42; 83/209; 83/210; 83/364; 83/365; 83/367; 83/369; 83/371; 226/24; 364/479

[58] Field of Search ..... 83/364, 365, 367, 369, 83/370, 371, 209, 210, 42, 72; 221/1; 226/10, 24; 364/479, 562

[56] References Cited

U.S. PATENT DOCUMENTS

| | | | |
|---|---|---|---|
| 3,802,306 | 4/1974 | Brown et al. | 83/370 |
| 3,868,877 | 3/1975 | Shoji et al. | 83/364 |
| 3,967,518 | 7/1976 | Edwards | 83/210 |
| 4,056,024 | 11/1977 | Baert et al. | 83/371 |
| 4,106,685 | 8/1978 | Strunc et al. | 83/369 |
| 4,273,319 | 6/1981 | Stocker | 83/210 |
| 4,436,008 | 3/1984 | Strunc | 83/364 |
| 4,456,193 | 6/1984 | Westover | 226/24 |
| 4,594,923 | 6/1986 | Fujita | 83/370 |
| 4,653,009 | 3/1987 | Brown | 364/479 |

*Primary Examiner*—Paul A. Bell
*Assistant Examiner*—Scott A. Smith
*Attorney, Agent, or Firm*—Townsend & Townsend

[57] ABSTRACT

An automatic ticket dispensing machine and a method for operating it to automatically adjust itself to the size of tickets being dispensed. A strip of tickets is fed forward with an advancing mechanism past an optical sensor which detects the perforations between tickets. The optical sensor is coupled to a controller which controls the advancing mechanism. The controller determines the length of the ticket by monitoring the distance the tickets are advanced between detections of perforations. In response to a request for a ticket, the controller advances the ticket strip by a distance corresponding to the predetermined ticket length of output.

15 Claims, 8 Drawing Figures

TICKET DISPENSING MACHINE AND METHOD

BACKGROUND

The present invention relates to apparatus for automatically dispensing tickets which are joined together and connected by a perforated junction.

There are a variety of designs for machines which dispense tickets, stamps or the like which are joined together by perforated joints on a roll. One type of machine, shown in U.S. Pat. No. 3,319,820 to Shigeharu Matsuda, et al. advances a strip of cards joined by perforations between two sets of rollers. When a card is to be torn off, a first set of rollers is stopped with the second set of rollers continuing so that the tension between the rollers tears the perforated joint to separate the card. Another type of machine shown in U.S. Pat. No. 2,699,100 to Simjian shows sprockets which engage holes in the side of a ticket to align the tickets with respect to a cutter blade which separates the tickets. A similar machine is shown in U.S. Pat. No. 4,060,177 to Surber, Jr. The Surber device relies on bending a strip of tickets so that the perforated joint contacts a paddle extending from a wheel around which the strip of tickets is fed so that the perforated joints become aligned with the paddles, enabling the tickets to be delivered to a cutting blade in alignment.

Other ticket dispensing mechanisms use optical detectors to determine when a ticket should be cut. For instance, U.S. Pat. No. 3,978,958 to Zandstra shows a ticket dispensing machine with an optical detector which senses the leading edge of the ticket being dispensed. The optical detector is mechanically positioned so that it is a ticket length in front of a cutting blade. The cutting blade is activated when the leading edge of the ticket is detected. The Zandstra device can be modified for various ticket lengths by mechanically moving the optical detector along a slideway to vary its position with respect to the cutting blade.

The machine disclosed in U.S. Pat. No. 3,621,964 to Riddle uses an optical detector to detect the perforations between stamps in a stamp machine. The optical detector provides a pulse each time a perforation is detected so that the number of tickets dispensed can be counted. When the required number of pulses are received by the control circuit, the advancing mechanism for the tickets is stopped. A time delay is built into the control circuit so that the time between the receipt of the last pulse from the optical detector and the stopping of the advancing mechanism is equal to the amount of time for the last perforation detected to travel from the optical detector to the cutting blade. By relying on the amount of time for the strip of stamps to advance to align the cutter with the perforation, the device automatically adjusts for varying ticket lengths. However, the time delay in the electronic circuit and the motor speed must be precisely synchronized and the optical sensor must be precisely placed with respect to the cutting blade to insure proper operation.

Lottery tickets come in various sizes and shapes, but all have perforated joints and a reflective surface. A simple, economical machine capable of dispensing all types of lottery tickets is needed.

SUMMARY OF THE INVENTION

The present invention is an automatic ticket dispensing machine and a method for operating it to automatically adjust itself to the size of tickets being dispensed.

A strip of tickets is fed forward with an advancing mechanism past an optical sensor which detects the perforations between tickets. The optical sensor is coupled to a controller which controls the advancing mechanism. The controller determines the length of the ticket by monitoring the distance the tickets are advanced between detections of perforations. In response to a request for a ticket, the controller advances the ticket strip by a distance corresponding to the predetermined ticket length for output.

In the preferred embodiment, the ticket dispenser also includes a rotary cutter which cuts through the ticket strip at the perforations to separate the output ticket from the rest of the ticket strip. The cutter is activated by the controller, which also controls a stepper motor coupled to a pair of rollers for advancing the tickets. The optical sensor consists of a row of light-emitting diodes (LEDs) on one side of the ticket strip and a row of photo-detectors on the other side of the ticket strip. A second optical output sensor coupled just beyond the cutter detects reflections off of the ticket and produces a ticket output signal when these reflections disappear, indicating that the ticket has been successfully cut from the ticket sheet.

In operation, the ticket dispenser automatically calibrates to the size of the tickets being used by advancing the tickets until three perforations are sensed. A counter in the controller counts the number of steps of the paper advance stepper motor until monochromatic light from the LEDs above a certain threshold is detected, indicating a perforation. The width of the perforation is then counted, with one-half the width of the perforation being added to the counted ticket length. By using one-half the perforation length, errors due to the tickets being skewed at an angle are avoided. Three iterations are done and averaged to obtain the average ticket length. Ticket lengths exceeding preset limits are not used in determining the average ticket length. Thereafter, the tickets are retracted to a position where the leading edge of a first ticket is immediately behind the rotary cutter. The position of the cutter is measured relative to the optical output sensor, which is accurately mounted relative to the rotary cutter. The distance from the optical perforation sensor to the optical output sensor can be measured electronically by counting the number of steps required for the stepper motor to advance the leading edge of the first ticket from the perforation sensor to the output sensor. Thus, variations in the exact location of the optical perforation sensor are automatically compensated for, eliminating the need for precise alignment during manufacturing of the larger, more difficult to mount perforation sensor.

To dispense a ticket, in a first simple embodiment an input button is pressed, signaling the controller to dispense one ticket. The controller then instructs the paper advance stepper motor to advance the ticket strip until a first perforation is adjacent the rotary cutter. The controller then instructs a stepper motor for the rotary cutter to sever the ticket and verifies from the optical ticket output sensor that the cut has been successful. Alternately, a keyboard input could be used instructing the controller to issue a variable number of tickets. In the preferred embodiment, the ticket dispenser is provided with a serial port coupled to the controller, allowing external control by another controller or computer and also allowing the passing of data regarding the number of tickets issued, etc. The ticket dispensing machine can be mounted in user activated terminals or dealer activated terminals for lottery tickets.

By measuring the actual distance between perforations, the present invention eliminates the need for precise timing calibration between a motor and an electronic delay circuit. An additional advantage of the present invention is that a ticket will be counted and properly advanced even if the perforation between it and an adjacent ticket is blocked so that it is not sensed by the optical sensor, since the present invention relies on the actual distance determined during a calibration routine.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
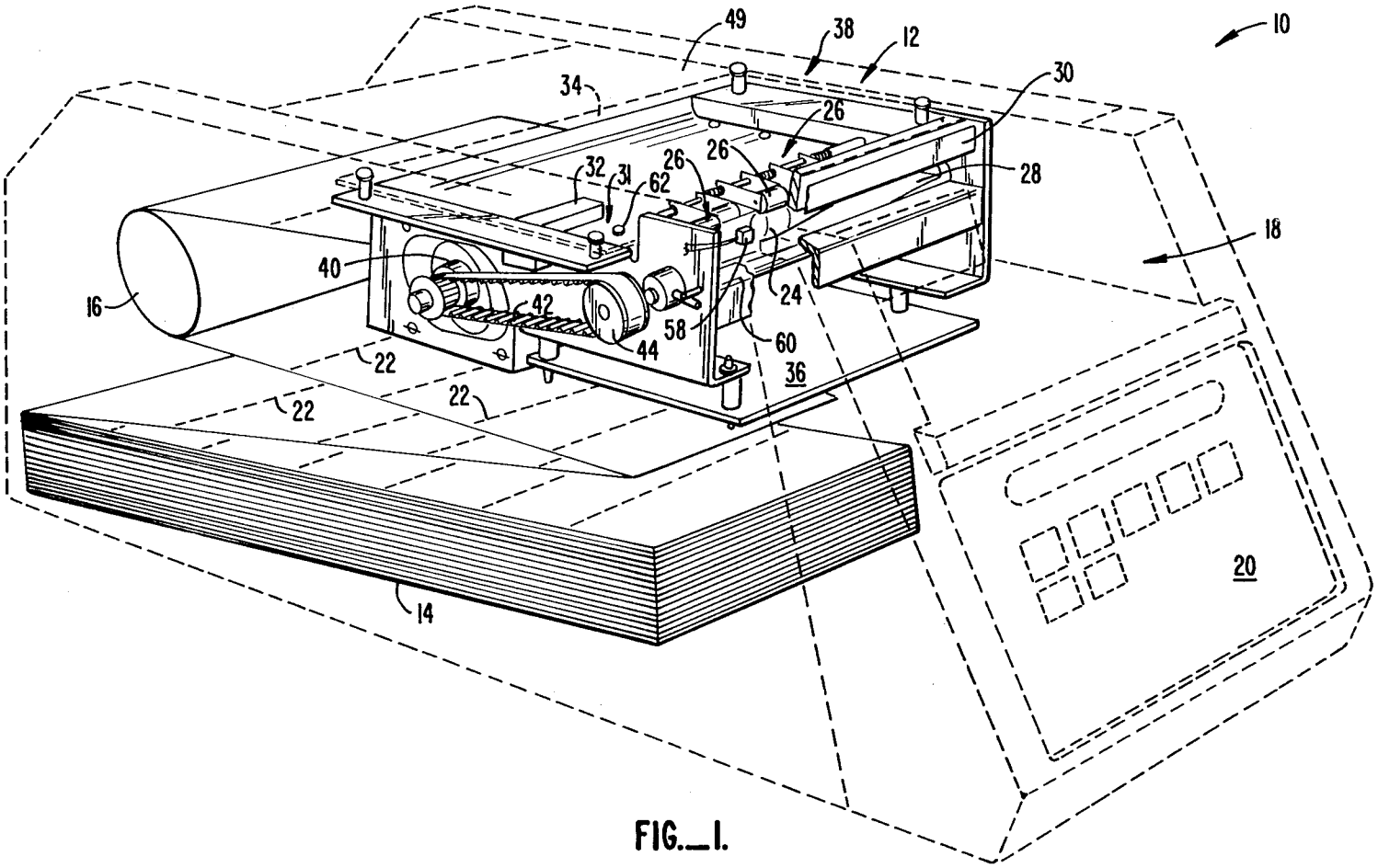
FIG. 1 is a perspective view of a lottery ticket terminal incorporating an automatic ticket dispenser according to the present invention.

FIG. 1 is a perspective view of a lottery ticket terminal 10 incorporating an automatic ticket dispenser 12 according to the present invention. A ticket strip 14 is fan-folded and passes a roller 16 on its way to ticket dispenser 12, from which it is output into a slot 18. A control panel 20 allows the inputting of instructions and the display of the status of the machine. Terminal 10 can be constructed in many different forms and can be tied to a central controller either through direct wiring or across the phone lines.

Strip of tickets 14, with individual tickets joined by perforated junctions 22, is fed between a roller 24 and a series of spring tensioned rollers 26. Ticket sheet 14 then passes between a rotary cutter 28 and a fixed cutting blade 30. The strip of tickets 14 passes through a central slot 31 in an optical detector 32, which has a row of light-emitting diodes (LEDs) on one side and a row of photo-detectors on the other side. Optical detector 32 produces a signal level proportional to the amount of monochromatic light detected to a controller circuit on circuit board 34 (shown in phantom). The controller circuit of board 34 produces signals to motor drive circuitry on a motor drive board 36 which provides the drive signals for a cutter stepper motor 38 and a paper advance stepper motor 38. Cutter stepper motor 38 can be seen more clearly in FIG. 2, which shows the side of the ticket dispenser which is hidden in the view of FIG. 1. Motor 40 is coupled to a drive belt 42 which is coupled to a drive wheel 44. Drive wheel 44 is coupled to roller 24. Roller 24 has a polyurethane covering for making frictional contact with strip of tickets 14. A plate 49 is a mechanical guide for the strip of tickets 14 which can be adjusted for the ticket width using screws 51.

Figure 2:
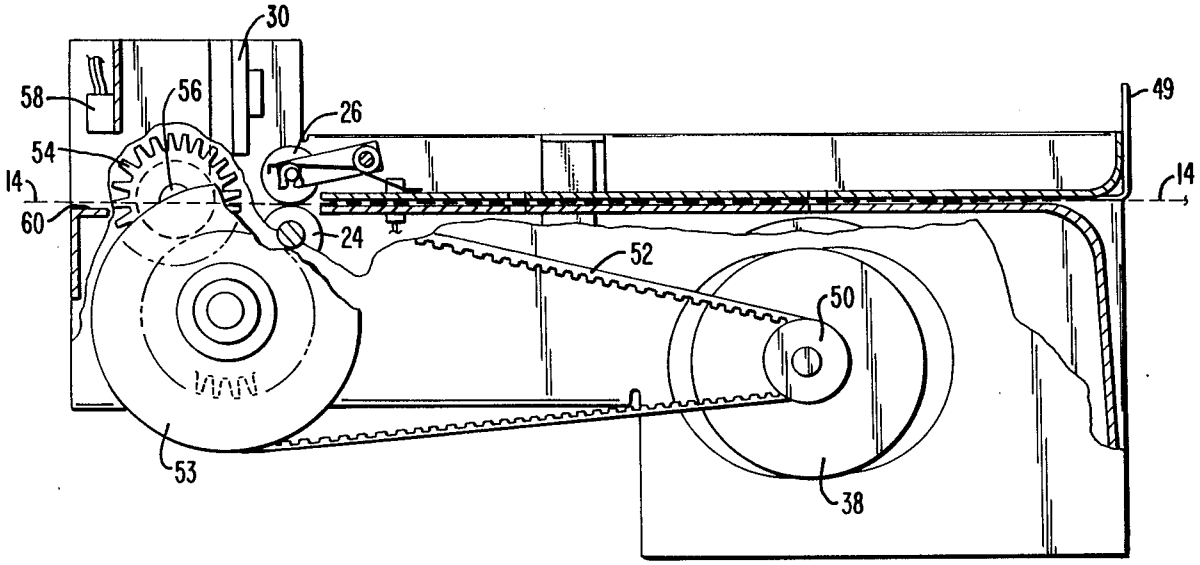
FIG. 2 is a side plan view of the ticket dispenser of FIG. 1.

On the opposite side of the ticket dispenser, as shown in FIG. 2, stepper motor 38 is coupled to a drive wheel 50 which drives a drive belt 52 coupled to gears 53, 54. Stepper-motors 38 and 40 are both two pole motors made by Howard Industries with an increment of approximately 0.0039 inches per step. Gears 53, 54 provide additional torque to a shaft 56 coupled to rotary cutter 28. Rotary cutter 28 is normally held in the open position, but when a cut is required, it does a half turn to sever a ticket at its perforated junction by a scissors effect between the rotary cutter and fixed spring blade 30. The scissors cutting action also makes the blades self-sharpening.

An optical output sensor 58 detects light reflected off of the reflective surface of ticket sheet 14. When a ticket is cut, light from detector 58 impinges upon a black surface 60 in front of rotary cutter 28 and the reduced monochromatic light reflections indicate the output ticket has been cut. A signal is then produced to the controller board 34 indicating that the ticket has been successfully output.

An additional optical sensor 62 of the same type as sensor 58 is provided to detect a black top-of-form mark on strip of tickets 14. This mark will be detected when reduced light is reflected back from the black top-of-form spot to detector 62.

Figure 3:
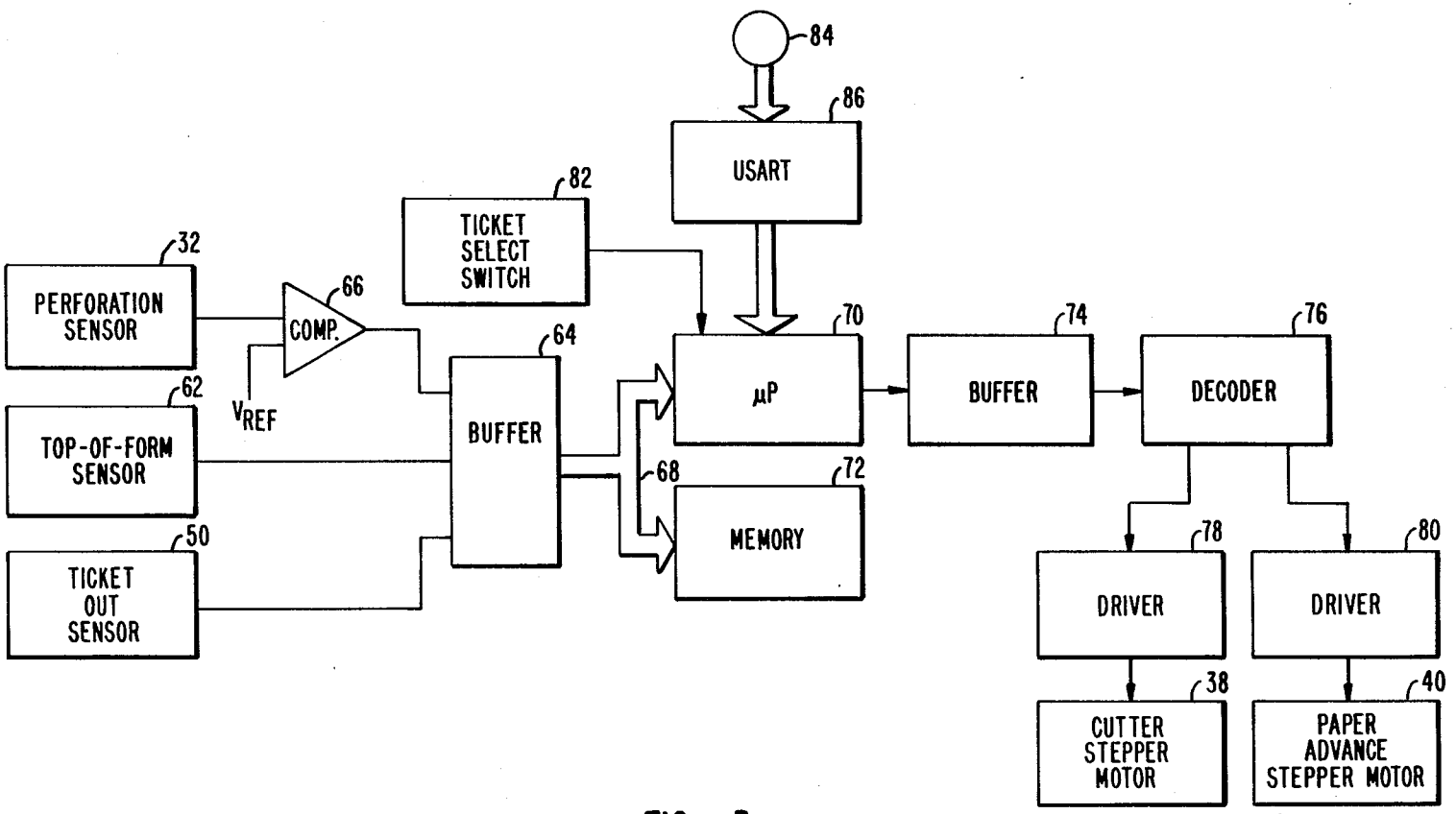
FIG. 3 is a block diagram of the electronic control system for the ticket dispenser of FIG. 2.

FIG. 3 illustrates in block diagram form the electronic circuit of circuit boards 34 and 36. Perforation sensor 32, top-of-form sensor 62 and ticket out sensor 58 are all coupled to a buffer 64. Perforation sensor 32 is coupled through a comparator 66 which compares the signal level to a predetermined value indicating that enough light is detected to indicate the presence of a perforation. By using LEDs which emit monochromatic light, the detector can work even in the presence of ambient light.

The output of buffer 64 is coupled via a data bus 68 to a microprocessor 70 with its associated memory 72. Microprocessor 70 stores data in memory 72 and analyzes the data. Microprocessor 70 provides control signals to a buffer 74, a decoder 76 and motor drivers 78, 80. Drivers 78, 80 are coupled to cutter stepper motor 38 and paper advance stepper motor 40, respectively. To step the motors, each motor is supplied with two pulse trains, one for each pole of the two pole stepper motor. The order of the pulses controls the direction of the motor, and the time between pulses controls the speed. Microprocessor 70 directs the proper pulse train, including ramping-up and ramping-down the pulses for starting and stopping the motor.

A ticket select switch 82 is provided as an input to microprocessor 70 to command the output of a ticket. Alternately, a keyboard could be used to indicate commands for more complicated functions, such as the issuance of multiple tickets. A serial port 84 coupled through a universal synchronous/asynchronous receiver-transmitter (USART) 86 is provided to allow the coupling of microprocessor 70 to an external keyboard or controller. Alternately, the serial port can be coupled to a modem for transmission over telephone lines of appropriate instructions or data.

In general, the ticket dispensing machine according to the present invention operates as follows. The machine first calibrates the ticket strip by moving the ticket strip forward until three perforations are detected, while counting the number of steps the stepper motor has moved between detected perforations. A running average is formed of the ticket length. When a perforation is detected, the ticket length counter stops and the length of the perforation is counted. The length of the perforation will be equal to the number of steps the stepper motor is advanced while the perforation is detected. This perforation length is divided by two and added to the base length of the ticket. This method will find the center of the perforation even if the perforation is at an angle relative to the perforation sensor due to the sensor being mounted at a slight angle or the ticket strip being skewed.

Maximum and minimum ticket length criteria are provided in the program. If a ticket length is over the maximum, it is not included in determining the average. The same applies if the ticket length is less than a minimum criteria.

After calibration, the ticket strip is backed up until the end of the ticket strip is behind the rotary cutter. This requires ticket-out sensor 58 to be mounted precisely with respect to rotary cutter 28. However, perforation detector 32 need not be accurately mounted since its position with respect to ticket-out sensor 58 can be determined by counting the number of steps between the leading edge of the first ticket passing the perforation sensor and reaching the ticket-out sensor.

When a ticket is to be dispensed, the ticket strip is advanced an amount equal to the calculated ticket length and the rotary cutter is actuated to sever the ticket. Since the ticket length has been calculated, the device according to the present invention does not rely upon the detection of a perforation after calibration to issue a ticket, thus eliminating errors due to blocked perforations. A blocked perforation is accounted for in a calibration routine by discounting ticket lengths exceeding a maximum criteria and also by requiring the average of a number of ticket lengths.

The flowchart of FIGS. 4A–4E illustrates the operation of a ticket dispensing machine according to the present invention in more detail. The program illustrated in the flowchart is preferably located in a read-only memory coupled to the microprocessor controller for the machine. Upon power-up or the receipt of an interrupt signal, the program performs diagnostics and initializes variables (Step A). After initialization, a subroutine for calibrating the ticket length is run (Step B). The program is then run with the first check being to determine whether the strip of tickets in the machine has run out (Step C). This can be accomplished by several methods, either alone or in conjunction with each other. First, the controller can count the number of tickets issued and subtract this from a total number of tickets on the strip (input to the controller upon loading or designation of the ticket type). Alternately, or in combination, the sensors can be used to detect the absence of an additional ticket. For instance, the indication of a long perforation can be interpreted to mean the end of the last ticket.

If the last ticket is out, the calibrate ticket length routine is run again upon the assumption that a new strip of tickets will be inserted into the machine (Step D). The program then checks for errors in the calibration routine, such as the failure to detect an average ticket length (Step E). If an error is detected, the program will wait for operator reset (Step F) and will restart upon reset. If s ticket is requested (Step G) the program runs a dispense ticket subroutine (Step H).

Figure 4A:
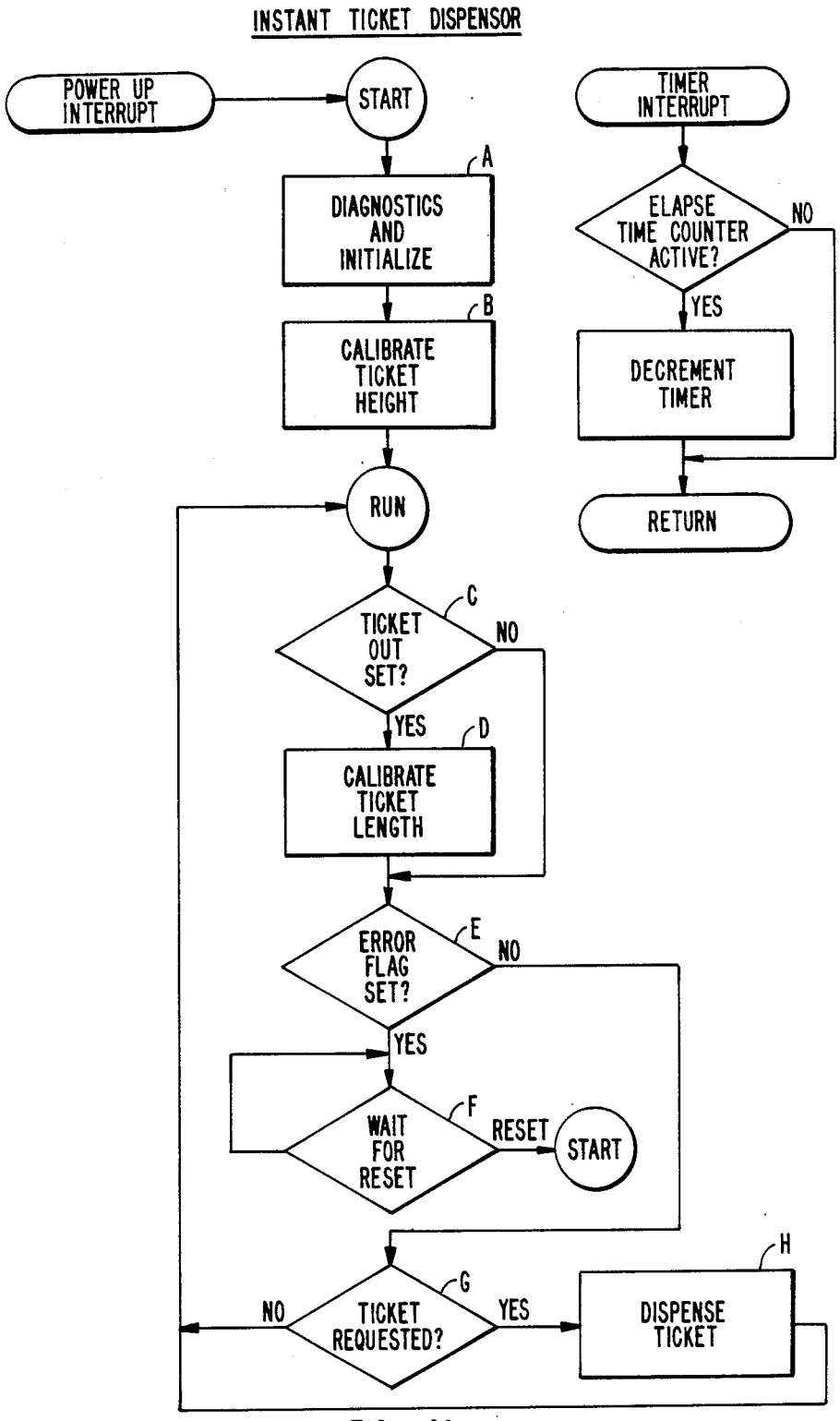
FIGS. 4A–4E are flowcharts of the operation of the ticket dispenser of FIG. 2.
Figure 4B:
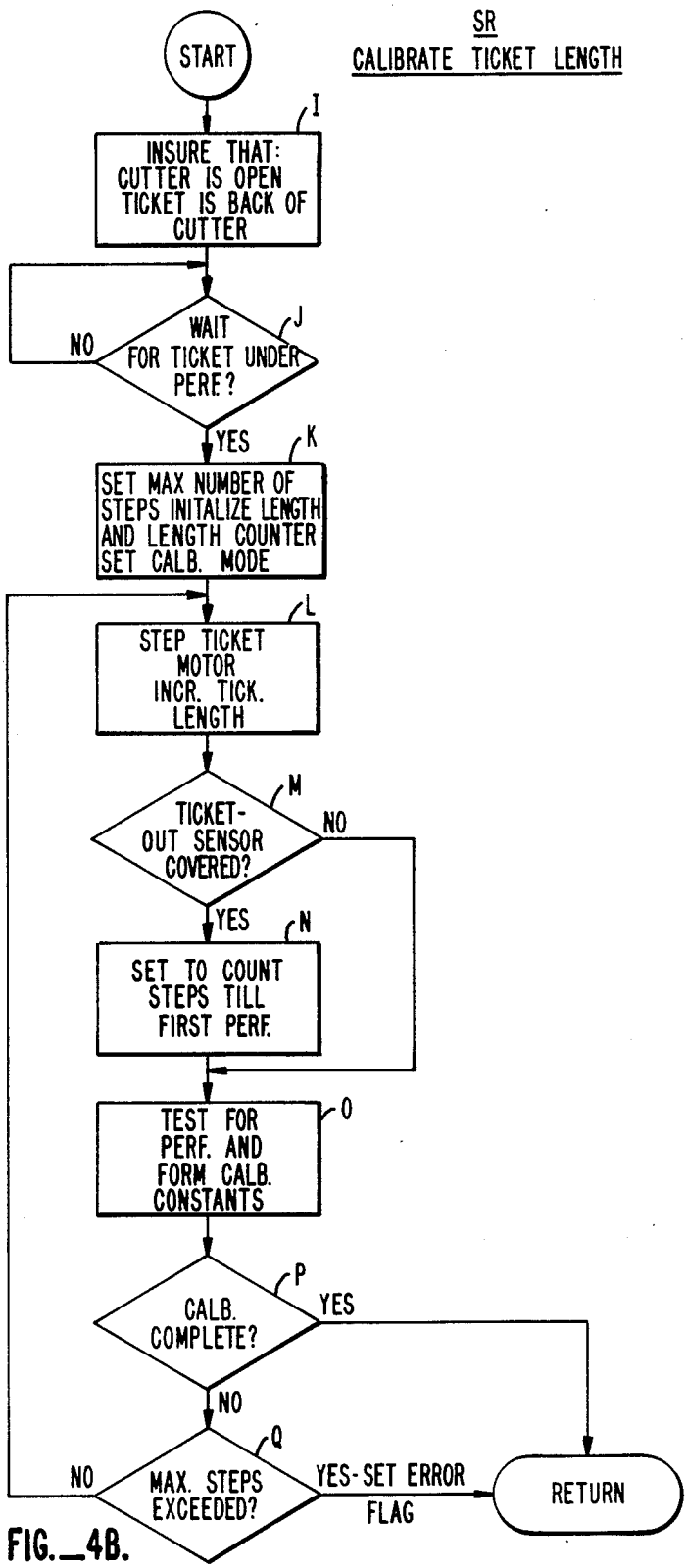

FIG. 4B is a flowchart of the Calibrate Ticket Length subroutine (Steps B,D) of FIG. 4A. The subroutine initially verifies that the rotary cutter is open and that the leading edge of the ticket is in back of the rotary cutter (Step I). The program then waits until a ticket is detected under the perforation sensor (Step J). When a ticket is detected, a maximum number of steps for a maximum ticket length is set and a ticket length counter is initialized (Step K). The ticket advance motor is then stepped, with the ticket length counter being incremented for each such step (Step L). The ticket-out optical sensor is then checked to determine if the ticket has been sensed yet (Step M). Once a ticket has been detected by the ticket-out sensor, a counter is initialized to count the number of steps until the first perforation so that the controller will know how far to advance the ticket strip in order to cut a ticket (Step N). This step eliminates the need for the perforation sensor to be accurately placed with respect to the cutter. Only the ticket-out sensor need be accurately placed so that the distance between it and the cutter is precisely known.

The perforation test subroutine (Step O) is then run. After this subroutine, the program tests to determine if calibration is complete (Step P). Calibration will be complete when the process has been run through enough times to detect three perforations. When calibration is complete, the ticket advance motor is instructed to retract the tickets to a position where the leading edge of the first ticket is immediately behind the cutter blade. A check is run to determine whether the stepper motor has advanced a number of steps greater than the maximum ticket length before detecting a perforation or without detecting a perforation (Step Q).

Figure 4C:
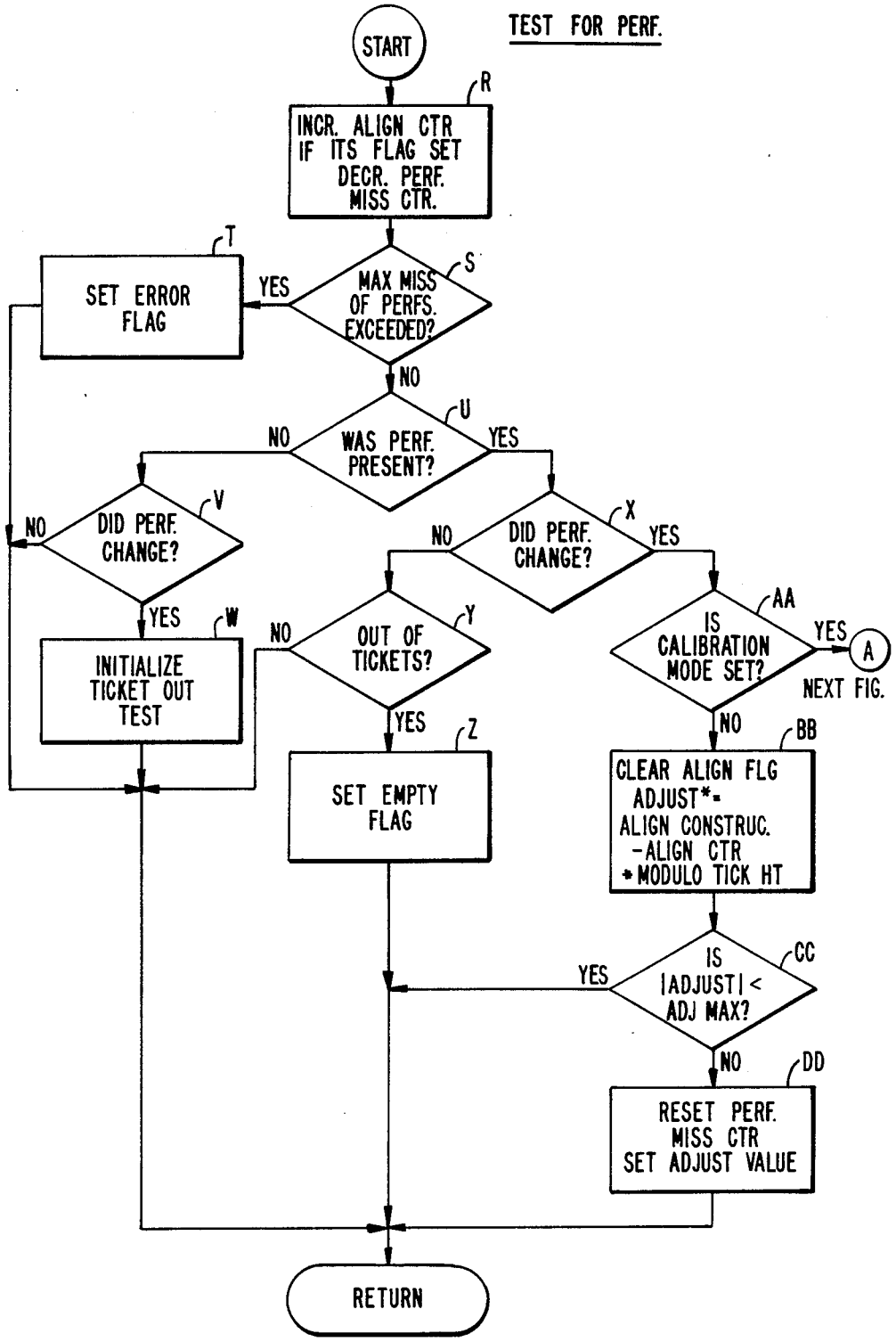
Figure 4D:
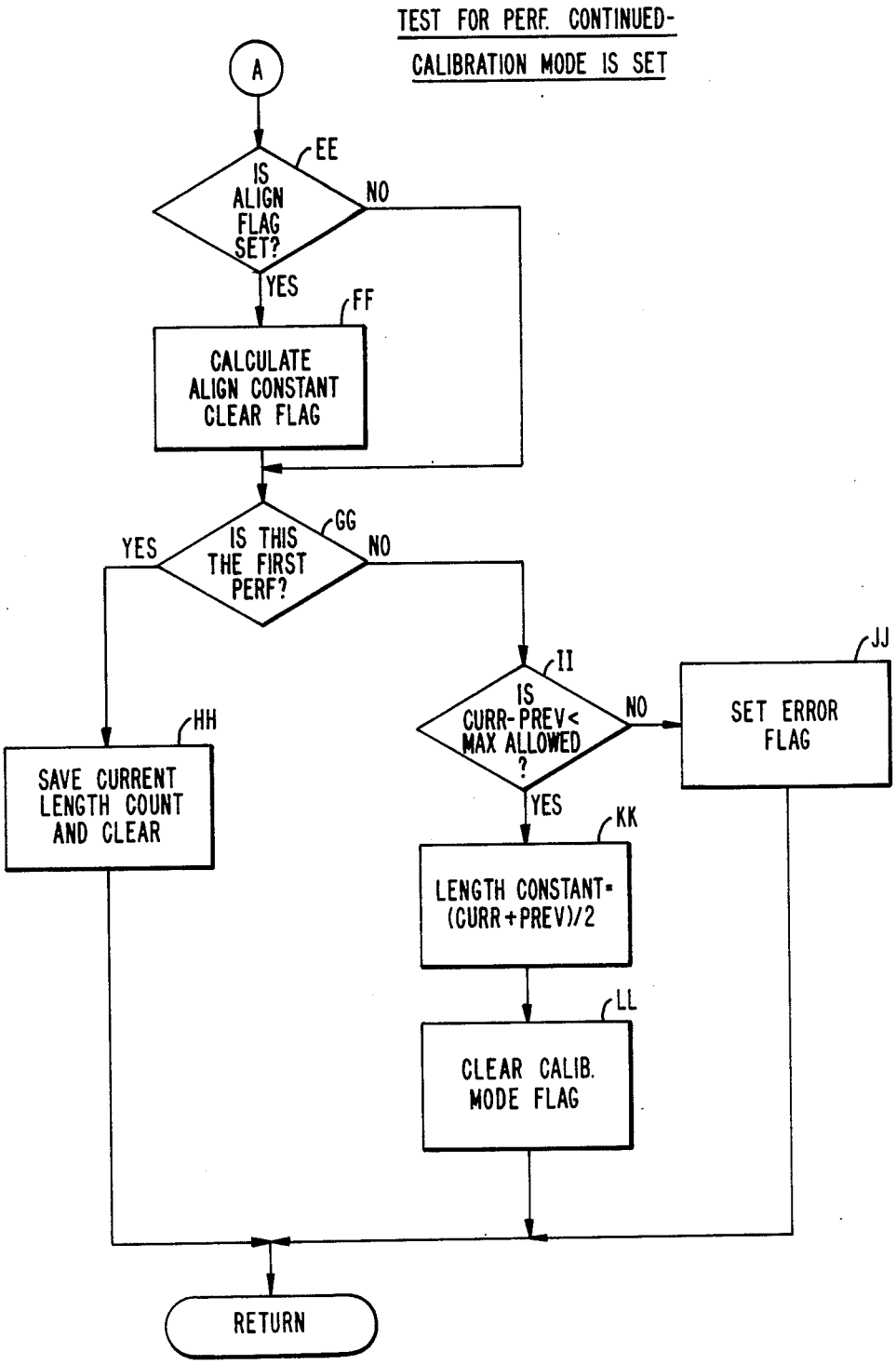

The perforation test subroutine (Step O) is set forth in FIGS. 4C and 4D. The perforation test subroutine first increments an alignment counter if an alignment flag is set and decrements a perforation miss counter (Step R). The alignment flag will be set when a perforation length exceeds a set maximum. A check is then done to determine if a maximum number of missed perforations has been exceeded (Step S). If the maximum number, preferably three, has been exceeded, an error flag is set (Step T). Otherwise, the program checks to determine whether a perforation is present (Step U). If no perforation is present, the program checks to determine whether the perforation width changed (Step V). If the perforation width did change, a ticket-out test is run (Step W). The ticket-out test is run on the assumption that a perforation width change may indicate that the strip of tickets has run out, resulting in the end of the last ticket being detected as a wide perforation.

If a perforation is present, the subroutine also checks to determine if the perforation width changed (Step X). If there is no change in the perforation width, the program checks to determine if the machine is out of tickets (Step Y). If the machine is not out of tickets, the subroutine ends, otherwise an empty flag is set (Step Z).

If the perforation length did change after perforation was detected, the subroutine determines whether the calibration mode is set (Step AA). If the program is not in the calibration mode, the alignment flag is cleared and an adjusted ticket length is set to be equal to an alignment constant minus the alignment counter amount times the average ticket length (Step BB). This gives an ongoing adjustment of the position of a perforation to compensate for stretching of the strip of tickets or other causes of changes in alignment, such as slippage. If the adjusted length is less than a maximum predetermined value (Step CC) the subroutine ends. If not, the perforation miss counter is reset and the adjusted ticket length is set to the new value.

If the calibration mode had been set for Step AA above, the calibration routine of FIG. 4D is run. If the alignment flag is set (Step EE) then the alignment constant is calculated and the flag is cleared (Step FF). The program then tests to determine whether this is the first perforation detected (Step GG). If it is the first perforation, the current length count is saved and the length counter is cleared (Step HH). Otherwise, the current length is subtracted from the previous length and compared to the maximum allowed difference (Step II). If the maximum distance is exceeded, an error flag is set (Step JJ). Otherwise, the length constant is set at the current plus the previous value divided by two (Step KK). The calibration mode flag is then cleared, since the calibration is complete (Step LL).

Figure 4E:
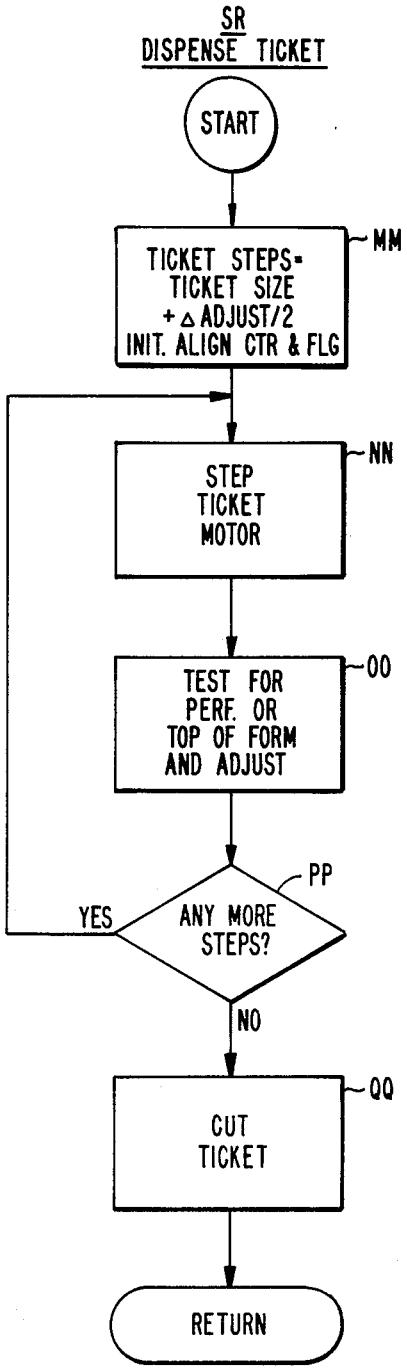

The dispense ticket subroutine, Step H of FIG. 4A, is shown in FIG. 4E. The number of ticket steps is set to be equal to the ticket size plus the adjusted perforation length divided by two (Step MM). The ticket motor is then stepped the required number of counts equal to the ticket steps (Step NN). The perforation test is then run or the top-of-form test is run and an adjustment is done (Step OO). A check is done to determine if more steps are needed (Step PP). If more steps are needed, the ticket motor is stepped again (Step NN), otherwise the ticket is cut (Step QQ) and the subroutine ends.

As will be understood by those familiar with the art, the present invention may be embodied in other specific forms without departing from the spirit or essential characteristics thereof. For example, a cutting mechanism other than a rotary cutter could be used. Accordingly, disclosure of the preferred embodiments of the invention is intended to be illustrative, but not limiting, of the scope of the invention which is set forth in the following claims.

What I claim is:

1. A method for dispensing tickets from a strip of tickets having perforated joints, comprising the steps of:
   advancing said strip of tickets past an optical sensor;
   sensing a plurality of perforations with said optical sensor;
   measuring the distance said strip of tickets is advanced between sensed perforations;
   calculating an average ticket length from the measured distances between perforations;
   indicating a desired number of tickets to be issued; and
   advancing said strip of tickets a distance equal to said average ticket length multiplied by said desired number of tickets.

2. The method of claim 1 further comprising the steps of:
   sensing a reflection off said strip of tickets at an output for said tickets with a second optical sensor;
   calculating a distance from said first mentioned optical sensor to said second optical sensor; and
   retracting said strip of tickets to a position before said second optical sensor after calculating said average ticket length.

3. The method of claim 2 further comprising the steps of:
   providing a cutting mechanism before said second optical sensor;
   subtracting a distance from said cutting mechanism to said second optical sensor from said distance from said first optical sensor to said second optical sensor;
   retracting said strip of tickets to a position behind said cutting mechanism after calculating said average ticket length; and
   cutting said strip of tickets after advancing said strip of tickets a distance equal to said average ticket length multiplied by said desired number of tickets.

4. The method of claim 1 wherein said distance measuring step comprises counting a number of pulses provided to a stepper motor for advancing said strip of tickets.

5. The method of claim 1 wherein said step of calculating an average ticket length further includes the steps of:
   measuring an average length of said perforations; and
   adding half of said average perforation length to said average ticket length.

6. An apparatus for dispensing tickets from a strip of tickets having perforated joints, comprising:
   means for advancing said strip of tickets to an output area;
   an optical sensor for detecting perforations between tickets;
   input means for requesting the output of one or more tickets; and
   control means for calculating a ticket length from a signal from said optical sensor and providing a drive signal to said advancing means to advance said strip of tickets a distance proportional to said ticket length multiplied by a number of requested tickets indicated by said input means.

7. The apparatus of claim 6 further comprising cutting means, responsive to a cutting signal from said control means, for severing a perforated junction between two tickets of said strip of tickets.

8. The apparatus of claim 7 wherein said cutting means comprises a rotary cutter and a fixed blade disposed on opposite sides of a path for said strip of tickets.

9. The apparatus of claim 8 further comprising a two pole stepper motor coupled to said rotary cutter for driving said cutter.

10. The apparatus of claim 7 further comprising an optical output sensor mounted proximate said cutting means for detecting reflections off said strip of tickets.

11. The apparatus of claim 6 wherein said advancing means comprises at least first and second pinch rollers disposed on opposite sides of said ticket strip, said first roller being driven by a motor and said second roller being tensioned by a spring against said first roller.

12. The apparatus of claim 11 wherein said motor is a two pole stepper motor.

13. The apparatus of claim 6 wherein said optical sensor comprises a row of light-emitting diodes disposed on a first side of said strip of tickets and a row of photodetectors disposed opposite said row of light-emitting diodes on a second side of said strip of tickets.

14. The apparatus of claim 13 wherein said light-emitting diodes emit monochromatic infrared light and said photodetectors detect monochromatic infrared light.

15. An apparatus for dispensing tickets from a strip of tickets having perforated joints, comprising:
   at least first and second pinch rollers disposed on opposite sides of said ticket strip, said second roller being tensioned against said first roller by a spring;
   a stepper motor coupled to said first roller for rotating said first roller to advance said strip of tickets;
   a row of light-emitting diodes disposed on a first side of said strip of tickets;
   a row of photodetectors disposed on a second side of said strip of tickets opposite said row of light-emitting diodes;

input means for requesting the output of one or more tickets;

cutting means for severing a perforated joint between two tickets of said strip of tickets; and control means for calculating a ticket length from a signal from said photodetectors, providing a first drive signal to said stepper motor to advance said strip of tickets a distance equal to said ticket length multiplied by a number of requested tickets indicated by said input means, and providing a second drive signal to said cutting means.

* * * * *